US011235589B2

(12) United States Patent
Cheng et al.

(10) Patent No.: US 11,235,589 B2
(45) Date of Patent: Feb. 1, 2022

(54) PRINTHEAD FOR A PRINTING APPARATUS

(71) Applicant: Datamax-O'Neil Corporation, Altamonte Springs, FL (US)

(72) Inventors: Yong Chiap Cheng, Singapore (SG); Chin Young Wong, Singapore (SG); Dionne Lim, Singapore (SG)

(73) Assignee: Datamax-O'Neil Corporation, Altamonte Springs, FL (US)

( * ) Notice: Subject to any disclaimer, the term of this patent is extended or adjusted under 35 U.S.C. 154(b) by 0 days.

(21) Appl. No.: 17/126,749

(22) Filed: Dec. 18, 2020

(65) Prior Publication Data

US 2021/0107293 A1 Apr. 15, 2021

Related U.S. Application Data

(63) Continuation of application No. 16/533,325, filed on Aug. 6, 2019, now Pat. No. 10,870,288, which is a (Continued)

(51) Int. Cl.
*B41J 2/335* (2006.01)
*B41J 2/375* (2006.01)
(Continued)

(52) U.S. Cl.
CPC ..... *B41J 2/375* (2013.01); *B41J 2/3355* (2013.01); *B41J 2/33505* (2013.01); *B41J 11/00* (2013.01); *B41J 29/02* (2013.01); *B41J 2202/31* (2013.01)

(58) Field of Classification Search
CPC . B41J 2/32; B41J 2/335; B41J 2/33515; B41J 2/33535; B41J 2/33565;
(Continued)

(56) References Cited

U.S. PATENT DOCUMENTS 5,503,483 A 4/1996 Petteruti et al.
5,907,347 A 5/1999 Nagahata et al.
(Continued)

OTHER PUBLICATIONS

Notice of Allowance and Fees Due (PTOL-85) dated May 1, 2019 for U.S. Appl. No. 15/922,401.
(Continued)

*Primary Examiner* — Scott A Richmond
(74) *Attorney, Agent, or Firm* — Alston & Bird LLP

(57) ABSTRACT

Provided herein is a printing apparatus including a printhead movable between a first position and a second position. The printhead includes a first substrate and a second substrate. The first substrate and the second substrate define at least a first burn line and a second burn line, respectively, of heating elements disposed adjacent to a first edge and a second edge, respectively of the printhead. A printhead bracket receives the printhead in one of the first position or the second position. In the first position, the heating elements of the first burn line perform a printing operation and the printhead bracket is configured to preclude operation of the heating elements of the second burn line. In the second position, the heating elements of the second burn line perform a printing operation, and the printhead bracket is configured to preclude operation of the heating elements of the first burn line.

13 Claims, 8 Drawing Sheets

Related U.S. Application Data continuation of application No. 15/922,401, filed on Mar. 15, 2018, now Pat. No. 10,406,824.

(51) Int. Cl.
*B41J 29/02* (2006.01)
*B41J 11/00* (2006.01)

(58) Field of Classification Search
CPC .. B41J 2/3354; B41J 2/33545; B41J 2/33575; B41J 2/345; B41J 2/355; B41J 2/3551; B41J 2/375; B41J 2/33505; B41J 2/3355; B41J 29/02; B41J 2202/31; B41J 3/54
See application file for complete search history.

(56) References Cited

U.S. PATENT DOCUMENTS

| | | | | |
|---|---|---|---|---|
| 6,175,376 | B1 | 1/2001 | Austin et al. | |
| 8,485,745 | B2 | 7/2013 | Iwasaki | |
| 10,406,824 | B1 | 9/2019 | Cheng et al. | |
| 2004/0156664 | A1 | 8/2004 | Vives et al. | |
| 2006/0279625 | A1* | 12/2006 | Smolenski | B41J 2/325 347/223 |
| 2007/0030311 | A1 | 2/2007 | Tsujimoto | |
| 2015/0054906 | A1 | 2/2015 | Onodera | |
| 2018/0236793 | A1* | 8/2018 | Preliasco | B41J 29/54 |

OTHER PUBLICATIONS

Notice of Allowance and Fees Due (PTOL-85) dated Sep. 2, 2020 for U.S. Appl. No. 16/533,325.

* cited by examiner

PRINTHEAD FOR A PRINTING APPARATUS

CROSS-REFERENCE TO RELATED APPLICATIONS

This application is a continuation of U.S. application Ser. No. 16/533,325, filed Aug. 6, 2019, the entire contents of which are incorporated herein by reference. U.S. application Ser. No. 16/533,325 is a continuation of U.S. application Ser. No. 15/922,401, filed Mar. 15, 2018 and subsequently issued as U.S. Pat. No. 10,406,824, the entire contents of which are incorporated herein by reference.

TECHNOLOGICAL FIELD

Example embodiments of the present disclosure relate generally to printers, and more particularly, to a printhead for a thermal printing apparatus.

BACKGROUND

Traditionally, thermal printing and associated printers use heat energy to induce markings on record media often by selectively heating specific areas of record media or by heating a thermal transfer media (e.g., a ribbon) for various printing applications, such as label printing. Such thermal printers include a variety of assemblies, such as a printhead assembly, enclosed within a housing of the printer casing. Conventional printhead assemblies in thermal printers often include a thermal printhead that includes multiple resistor (e.g., heating) elements in burn lines, and, during operation, passage of electric current through such resistor elements energizes the resistor elements to perform a printing operation. In conventional assemblies, exhaustion of a burn line results in the end of life of the printhead, such that the expired printhead is required to be replaced with a new printhead in order to continue performing a printing operation.

Applicant has identified a number of deficiencies and problems associated with conventional printing apparatuses. Through applied effort, ingenuity, and innovation, many of these identified problems have been solved by developing solutions that are included in embodiments of the present disclosure, many examples of which are described in detail herein.

BRIEF SUMMARY

Printing apparatuses and associated printheads are disclosed herein for prolonging the life of a printhead. In one embodiment, a printing apparatus including a printhead moveable between at first position and a second position is provided. The printhead may include a first substrate that defines at least heating elements of a first burn line disposed adjacent to a first edge of the printhead, and a second substrate that defines at least heating elements of a second burn line disposed adjacent to a second edge of the printhead. The printing apparatus may include a printhead bracket configured to receive the printhead in one of the first position or the second position. In the first position, the heating elements of the first burn line may perform a printing operation, and the printhead bracket may preclude operation of the heating elements of the second burn line. In the second position, the heating elements of the second burn line may perform the printing operation, and the printhead bracket may preclude operation of the heating elements of the first burn line.

In some embodiments, in an instance in which the printhead is received by the printhead bracket in the first position, the printhead may be secured within the printhead bracket such that the first burn line is aligned with a proximal end of the printhead bracket and the second burn line is aligned with a distal end of the printhead bracket.

In some other embodiments, in an instance in which the printhead is received by the printhead bracket in the second position, the printhead may be secured within the printhead bracket such that the second burn line is aligned with a proximal end of the printhead bracket and the first burn line is aligned with a distal end of the printhead bracket.

In some further embodiments, the printing apparatus may include a control unit. The control unit may monitor a printing life of each of the first burn line and the second burn line and, in response to monitoring the printing life of each of the first burn line and the second burn line, may detect one or more alert conditions associated with at least the first burn line.

In such an embodiment, the detected one or more alert conditions may correspond to a malfunctioned state of the heating elements of the first burn line or to an end of printing life of the first burn line.

In other such embodiments, the control unit may, in response to detecting one or more alert conditions associated with at least the first burn line, determine a required movement of the printhead between the first position and the second position.

In some still further embodiments, the control unit may, in response to detecting the one or more alert conditions associated with at least the first burn line, generate a notification for presentation to a user for requesting a movement of the printhead between the first position and the second position. In such an embodiment, the movement of the printhead may correspond to a manual release of the printhead received by the printhead bracket in the first position and a manual rotation of the printhead to be received by the printhead bracket in the second position.

In other such embodiments, the control unit may, in response to detecting the one or more alert conditions associated with at least the first burn line, cause movement of the printhead between the first position and the second position. In such an embodiment, the movement of the printhead may correspond to an automatic release of the printhead received by the printhead bracket in the first position and an automatic rotation of the printhead for a receipt of the printhead by the printhead bracket in the second position.

In some embodiments, the printhead may further define a first surface supporting the first substrate and the second substrate, and a second surface opposite the first surface supporting at least a heat sink.

In such an embodiment, the printhead may further include a first connector positioned on the second surface to secure the printhead within the printhead bracket in the first position and/or a second connector positioned on the second surface to secure the printhead within the printhead bracket in the second position.

In some embodiments, the printing apparatus may include a control unit for selectively activating at least one of the heating elements of the first burn line or the second burn line to perform the printing operation.

In one embodiment, a printhead moveable between a first position and a second position is provided. The printhead may include a first substrate that defines at least a first burn line of heating elements disposed adjacent to a first edge of a printhead plate of the printhead. The printhead may include a second substrate that defines at least a second burn line of heating elements disposed adjacent to a second edge of the printhead plate of the printhead. The printhead may be movably received by a printhead bracket in one of a first position or a second position. In the first position, the heating elements of the first burn line may perform a printing operation, and operation of the heating elements of the second burn line may be precluded by the printhead bracket. In the second position, the heating elements of the second burn line may perform the printing operation, and operation of the heating elements of the first burn line may be precluded by the printhead bracket.

In some embodiments, in an instance in which the printhead is received by the printhead bracket in the first position, the printhead may be secured within the printhead bracket such that the first burn line is aligned with a proximal end of the printhead bracket and the second burn line is aligned with a distal end of the printhead bracket.

In some other embodiments, in an instance in which the printhead is received by the printhead bracket in the second position, the printhead may be secured within the printhead bracket such that the second burn line is aligned with a proximal end of the printhead bracket and the first burn line is aligned with a distal end of the printhead bracket.

In other embodiments, the printhead further defines a first surface supporting the first substrate and the second substrate, and a second surface opposite the first surface that supports at least a heat sink.

In some other embodiments, the printhead may include a first connector positioned on the second surface that secures the printhead within the printhead bracket in the first position. The printhead may also include a second connector positioned on the second surface that secures the printhead within the printhead bracket in the second position.

In some further embodiments, at least one of the heating elements of the first burn line or the second burn line may be selectively activated to perform the printing operation.

In some other embodiments, a movement of the printhead between the first position and the second position may correspond to a release of the printhead received by the printhead bracket in the first position and a rotation of the printhead to be received by the printhead bracket in the second position.

The above summary is provided merely for purposes of summarizing some exemplary embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which are further explained within the following detailed description and its accompanying drawings.

BRIEF DESCRIPTION OF THE DRAWINGS

The description of the illustrative embodiments may be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure according to one or more embodiments of the present disclosure are shown and described with respect to the figures presented herein, in which.

DETAILED DESCRIPTION

Figure 1A:
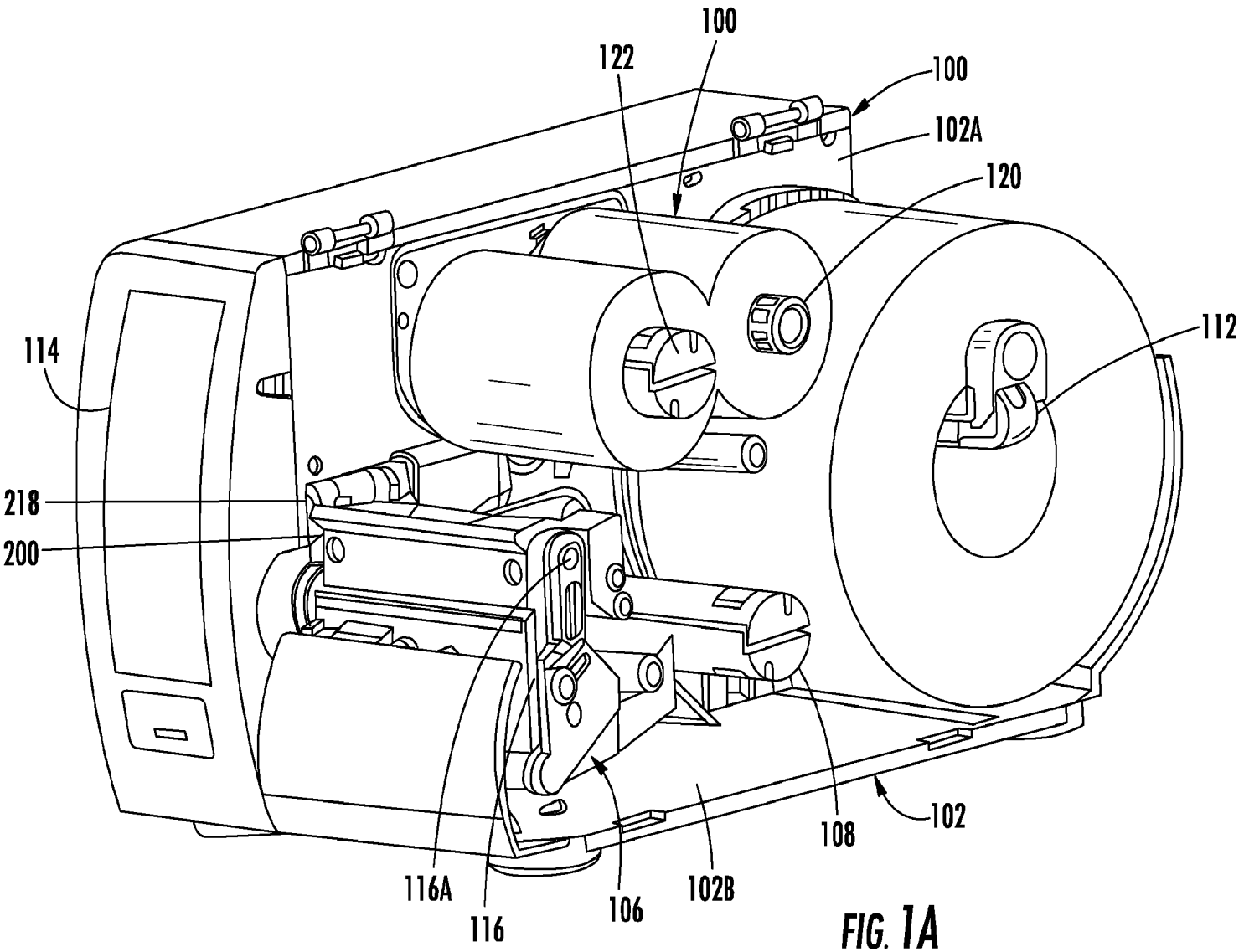
FIG. 1A illustrates a perspective view of a printing apparatus, in accordance with one or more embodiments of the present disclosure.

Some embodiments of the present disclosure will now be described more fully hereinafter with reference to the accompanying drawings, in which some, but not all embodiments of the disclosure are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. Terminology used in this patent is not meant to be limiting insofar as devices described herein, or portions thereof, may be attached or utilized in other orientations.

The term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of.

The phrases "in one embodiment," "according to one embodiment," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "may," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in an embodiment, or it may be excluded.

In some example embodiments, a printhead used in a thermal printer includes multiple resistors or heating elements in a burn line disposed on a substrate. With the passage of electric current for controlled time periods, such resistor elements may be energized to perform a printing operation. As described above in reference to conventional techniques, the exhaustion of the burn line indicates the end of life of the printhead such that the user is required to discard the exhausted printhead and required to obtain a new replacement printhead. In some examples, if the order and delivery of the new replacement printhead is delayed from the user's end, the completion of the printing job may also be delayed resulting in productivity and efficiency losses. Furthermore, these conventional printheads result in hardware wastage. Said differently, while the majority of the printhead components (e.g., a heat sink, substrate, and flexible print circuit) continue to perform their respective functionalities, the printhead must be disposed of when only a single component (e.g., the burn line) has deteriorated.

Thus, in some examples disclosed herein, a printhead is disclosed that has at least one additional burn line. In some examples, such additional burn lines enhance the printing life and capacity of the disclosed printhead while retaining a similar footprint as compared to traditional printheads.

In some embodiments, the disclosed printhead and printhead assembly may include a printhead plate that defines a first surface and a second surface. The second surface may be located opposite to the first surface. At least the first surface may include at least a first burn line on a first substrate and a second burn line on a second substrate. The first burn line may be disposed adjacent to a first edge of the first surface and the second burn line may be disposed adjacent to a second edge of the first surface of the printhead. The printhead may be movable in a printhead bracket between a first position and a second position such that the heating elements corresponding to the first burn line may be activated in the first position to perform a printing operation while the printhead bracket is configured to preclude operation of the heating elements of the second burn line. Similarly, the heating elements corresponding to the second burn line may be activated in the second position for performing the printing operation while the printhead bracket is configured to preclude operation of the heating elements of the first burn line.

The printhead disclosed in some example embodiments herein reduces hardware waste by re-using the remaining components (e.g., a heat sink, substrate, and/or flexible print circuit) on the printhead after the first burn line has deteriorated or worn out. In some embodiments, the depth of the disclosed printhead is comparatively bigger than existing printheads to accommodate an additional burn line and a larger heat sink. The larger heat sink may function to dissipate more heat from the disclosed printhead to further prolong the life of the printhead. Additionally, in some example embodiments, the disclosed printhead may be implemented with various computer-implemented components or software applications. This may allow for increased processing speeds and reduced memory requirements of the printing apparatus. Further, in some examples, the disclosed printhead may operate to increase the life of a printhead to at least twice that of existing printing apparatuses such that the user may order the new printhead as soon as the first burn line has deteriorated. In this way, the new printhead may be delivered to the user well in advance of the expiration of the second burn line that is performing the printing operation, thereby increasing the productivity and efficiency of the printing operation to be accomplished by the user.

Having described example embodiments, the design of the various devices performing various example operations is provided below. The components illustrated in the figures represent components that may or may not be present in various embodiments of the disclosure described herein such that embodiments may include fewer or more components than those shown in the figures while not departing from the scope of the disclosure.

FIG. 1A illustrates a perspective view of a printing apparatus 100, in accordance with one or more embodiments of the present disclosure. The printing apparatus 100 may include a casting 102, a printhead assembly 200, a support block assembly 106, a thermal ink printer media take-up assembly module 108, an ink ribbon printer media take-up assembly module 110, a media supply hub 112, and a display assembly 114. The printing apparatus 100 may further include a printhead latch 116, a rod 118, a ribbon supply assembly 120, and a ribbon take-up assembly 122.

In some embodiments, various components in the printing apparatus 100 may be independently attachable to and detachable from the casting 102. As such, the printing apparatus 100 may be easily and quickly converted from an ink ribbon printer to a thermal ink printer and vice-versa by installing the appropriate printhead assembly and the appropriate media take-up assembly module into the printing apparatus 100. Additionally, different circuit boards may be installed for selectively controlling operation of the printing apparatus 100. For example, different circuit boards or additional circuit boards may be installed to convert the printing apparatus 100 from the thermal ink printer to the ink ribbon printer or vice-versa.

The casting 102 may operate as a support body for the printing apparatus 100 and may include a central support member 102A and a base member 102B, which may be monolithically formed from a heat conductive material, such as cast aluminum, ceramics, plastics, sheet metal, and the like. By casting the central support member 102A and the base member 102B monolithically, heat dissipation from within the printing apparatus 100 may be improved, in some examples. The casting 102 may include various recesses configured to receive each of the assemblies in a specific orientation such that when each of the assemblies is secured to the casting 102, the assemblies are supported in an operative configuration.

Figure 2A:
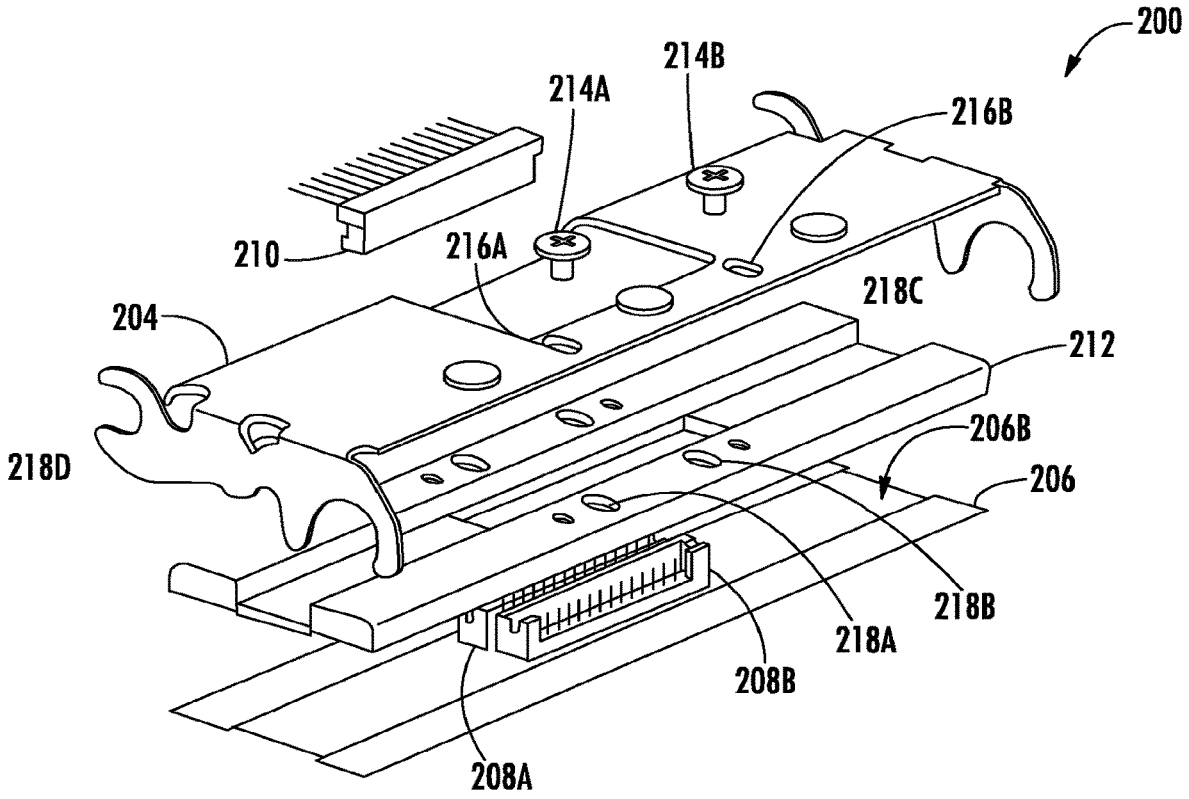
FIG. 2A illustrates a perspective view of a printhead assembly, in accordance with one or more embodiments of the present disclosure.
Figure 2B:
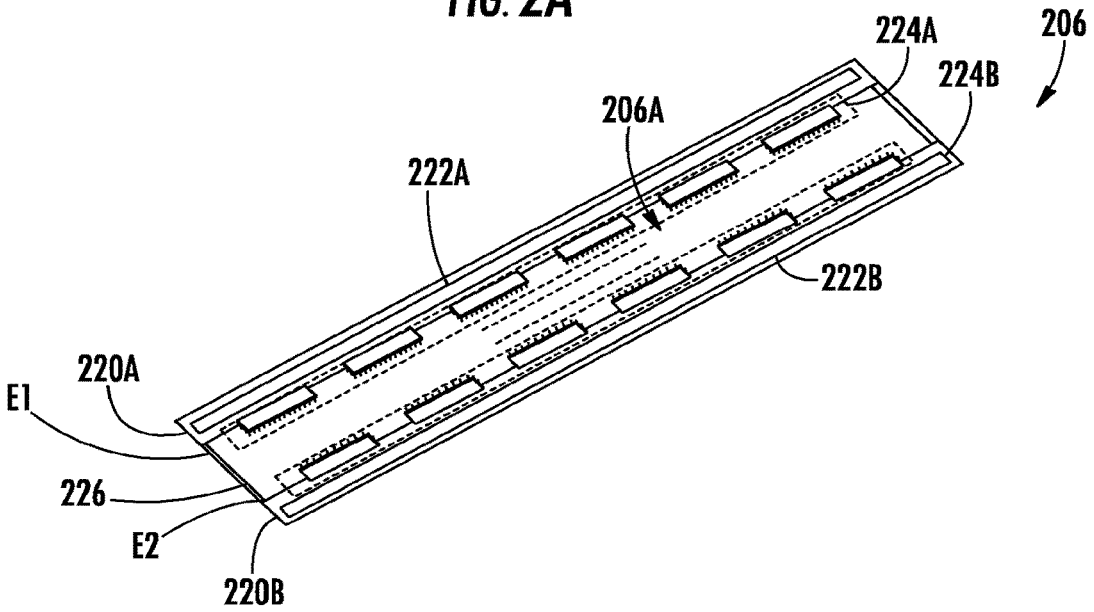
FIG. 2B illustrates a perspective view of a printhead of the printhead assembly of FIG. 2A, in accordance with one or more embodiments of the present disclosure.

An example printhead assembly 200, as described in detail in FIGS. 2A and 2B, may be configured to mate with a platen assembly (not shown in FIG. 1A). The printhead assembly 200 may also be pivotably mounted in the printing apparatus 100. In some embodiments, the printhead assembly 200 may form an integral unit or module that is bolted to the casting 102 to secure the printhead assembly 200 within the printing apparatus 100.

The support block assembly 106 may include various support portions, one or more of which may be releasably engaged with a portion of the printhead latch 116. The support block assembly 106 may include various components, such as a platen mounting block, a platen assembly having a platen roller, a retainer bracket, a media guide, and a tear bar (not shown in FIG. 1A). The platen roller in the platen assembly may be a motor generated driver that may drive the media forward/backward past the printhead assembly 200 and provide counter-pressure. The support block assembly 106 may further be a replaceable part in the printing apparatus 100.

The thermal ink printer media take-up assembly module 108 may include at least a hub assembly (not shown in FIG. 1A) configured to support a media take-up roll. The thermal ink printer media take-up assembly module 108 may be operable when the printing apparatus 100 is operated as a thermal ink printer.

The ink ribbon printer media take-up assembly module 110 may also include at least a ribbon supply assembly. The ink ribbon printer media take-up assembly module 110 may be operable when the printing apparatus 100 is operated as ink ribbon printer.

The media supply hub 112 may include at least a hub and an adjustable retaining member (not shown in FIG. 1A).

After the media supply roll is positioned on the hub, the adjustable retaining member may be pivoted back to a position perpendicular to the hub and slid into contact with the media supply roll to retain the media supply roll on the hub.

The display assembly 114 may include a module having a display (e.g., a light-emitting diode (LED) display, an organic light-emitting diode (OLED) display, a liquid-crystal display (LCD) display, a cathode ray tube (CRT), or the like) and a display casing. The display assembly 114 may present the status of the printing apparatus 100 and include operational and menu keys which may allow the user to change parameters of the printing apparatus 100 that control operation of the printing apparatus 100. The display assembly 114 may be configured to display commands and the parameters of operation in multiple languages.

The printhead latch 116 may be configured, when released from the support block assembly 106, to cause the printhead assembly 200 to become pivotable about the rod 118. By way of example, when pressure is applied on the button 116A of the printhead latch 116, the printhead latch 116 is released from the support block assembly 106. When the printhead assembly 200 is pivoted away from its normal or ready position, replacement of the ink ribbon or other maintenance operations, such as though described below with reference to FIGS. 3A-3H, may be performed.

The ribbon supply assembly 120 and the ribbon take-up assembly 122 may, in some embodiments, be operable in an instance in which the printing apparatus 100 is operated as a thermal transfer printing apparatus. The ribbon take-up assembly 122 may include a hub that is driven by the drive mechanism of printing apparatus 100 to unwind ribbon from the spool of ribbon positioned on the hub assembly of ribbon supply assembly 120. As ribbon is unwound from the hub assembly, torque from the spool of ribbon is translated from the spool of ribbon, through hub portions and torsion springs to a ribbon supply shaft (not shown in FIG. 1A). Accordingly, a back tension is created in the ribbon as each torsion spring is put in torque. Because the hub portions are independently rotatable about the ribbon supply shaft, the amount of back tension created in the ribbon is proportional to the width of the spool of ribbon. The ribbon take-up assembly 122 may be configured and adapted to receive the ribbon.

Figure 1B:
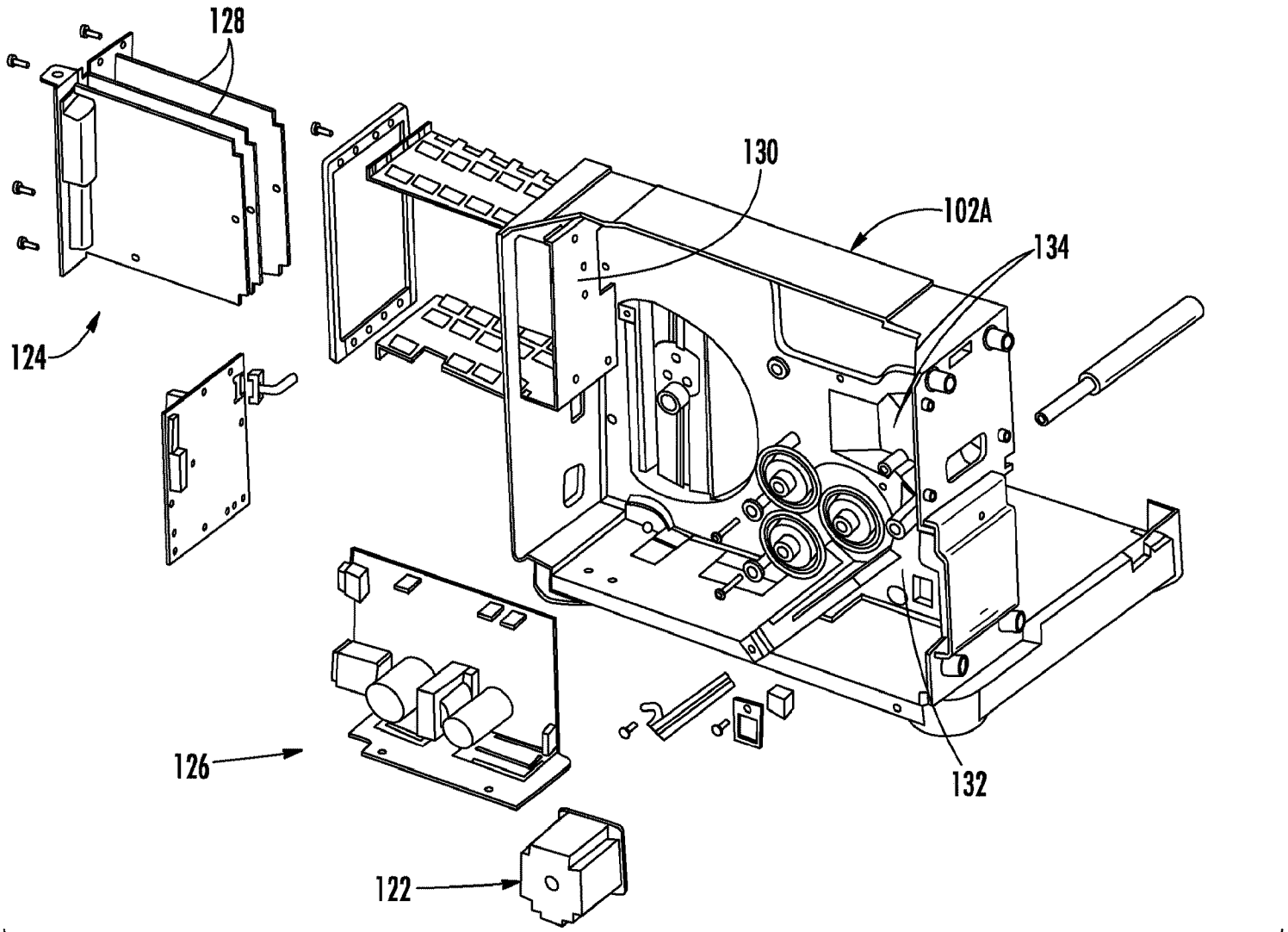
FIG. 1B illustrates another perspective exploded view of a printing apparatus of FIG. 1A, in accordance with one or more embodiments of the present disclosure.

FIG. 1B illustrates another exploded perspective view of the printing apparatus 100 of FIG. 1A, in accordance with one or more embodiments of the present disclosure. As illustrated, the electrical and drive components may be secured to the opposite side of the central support member 102A of the casting 102. The electrical and drive components may include a stepper motor assembly 122, electronic circuitry 124, and an electric drive assembly 126 that are secured to the central support member 102A on a side opposite to the printing components. The electronic circuitry 124 may include one or more circuit boards 128 that may be installed in the printing apparatus 100 by sliding the circuit boards 128 through an opening 130 formed in the casting 102. The circuit boards 128 may be chosen to suit a specific printing operation to be performed. For example, the electronic circuitry 124 may be changed to accommodate different communications interfaces. Alternatively, software can be downloaded via a mechanism, such as COM port or CUPS printer driver, to control a specific printing application. The casting 102 as illustrated may further include a first mounting location 132 and a second mounting location 134 that may be configured to receive the stepper motor assembly 122. While the printing apparatus 100 as illustrated in FIGS. 1A-1B is often configured for operation in commercial or industrial printing applications, the present disclosure contemplates that the printing apparatus 100 may be equally applicable to personal or desktop use.

FIG. 2A illustrates a perspective view of the printhead assembly 200, in accordance with one or more embodiments of the present disclosure. With reference to FIG. 2A, the printhead assembly 200 of the printing apparatus 100 may include at least a printhead 202 and a printhead bracket 204.

In some embodiments, the printhead 202 may further include a printhead plate 206 and a heat sink 212. The printhead plate 206 may define two opposite surfaces, a first surface 206A and a second surface 206B (as illustrated in FIG. 2A). The first surface 206A may correspond to the bottom surface of the printhead plate 206, the perspective view of which has been illustrated in FIG. 2B. The second surface 206B may correspond to the top surface of the printhead plate 206, the perspective view of which has been illustrated in FIG. 2A. The second surface 206B may be configured to support the heat sink 212.

In some embodiment, the printing apparatus 100 may be configured as a thermal transfer printing apparatus or a direct thermal printing apparatus. By way of example, a direct thermal printing may use specially treated label stock that contains dyes configured to appear black upon application of heat and pressure. In such an embodiment, the heating elements of the one or more burn lines of the first surface 206A of the printhead plate 206 (e.g., discussed hereinafter with reference to FIGS. 2A-3H) may be in direct contact with the media, such as the label stock. In another alternative embodiment, the printing apparatus 100 may be configured as an ink ribbon printer or a thermal transfer printing apparatus. By way of example, thermal transfer printing requires the use of a ribbon substrate having ink that is transferred onto a media upon application of heat and/or pressure to the ribbon substrate. In such an embodiment, the first surface 206A of the printhead plate 206 may be in direct contact the ink ribbon and the ink ribbon may be in direct contact with the media, such as the label stock.

In some embodiments, the second surface 206B of the printhead plate 206 may include a plurality of connectors, such as connectors 208A and 208B. The connectors 208A and 208B positioned on the second surface 206B may define extending contact pins such that the printhead 202 may be secured within the printhead bracket 204 in one of the first position or the second position for performing a printing operation. Once the printhead 202 is secured within the printhead bracket 204 in one of the first position or the second position, the mating connector 210 may connect with the one of the first connector 208A or the second connector 208B. For example, in some embodiments, the connector 208A may be configured to secure the printhead 202 within the printhead bracket 204 in the first position for performing the printing operation such that the mating connector 210 is connected to the first connector 208A. In another example, the connector 208B may be configured to secure the printhead 202 within the printhead bracket 204 in the second position for performing the printing operation such that the mating connector 210 is connected to the second connector 208B.

In an alternative or additional embodiment, the second surface 206B of the printhead plate 206 may include only one connector (not shown) that may secure the printhead 202 within the printhead bracket 204, in one of the first position or the second position for performing the printing operation. Consequently, the single connector may connect the printhead 202 with the mating connector 210 in the first position or the second position for performing the printing operation.

With continued reference to FIG. 2A, the printhead bracket 204 may be formed as a support housing configured to secure the printhead assembly 200 to an engagement member of the casting 102 of the printing apparatus 100. The printhead 202 may be movably received by the printhead bracket 204 in one of the first position or the second position. Structurally, in one embodiment, the printhead 202 may be secured within the printhead bracket 204 (in the first position) by screws 214A and 214B which are positioned within a first set of slots 216A and 216B (formed in the printhead bracket 204) and a corresponding first set of slots 218A and 218B (formed along one longitudinal edge of the printhead 202). In another embodiment, the printhead 202 may be secured within the printhead bracket 204 (in the second position) by the screws 214A and 214B which are positioned within the first set of slots 216A and 216B (formed in the printhead bracket 204) and another second set of slots 218C and 218D (formed along the opposite longitudinal edge of the printhead 202). The printhead bracket 204 may include a pair of pivot members which are slidably positioned in vertical slots in a printhead pivot. As the printhead bracket 204 pivots in the direction of the printhead mount and the media positioned within the printhead assembly 200, the printhead bracket 204 may be secured to the engagement member of the casting 102. The engagement between the printhead bracket 204 and the engagement member cams the pivot members upwardly in the vertical slots to lift the backend of the printhead bracket 204 to allow for substantially parallel closure of the printhead bracket 204 onto the printhead mount. The detailed movement of the printhead 202 between the first position and the second position has been described in reference to FIGS. 3A-3H below.

FIG. 2B illustrates a perspective view of the printhead 202, in accordance with one or more embodiments of the present disclosure. FIG. 2B is described in conjunction with FIG. 2A. With reference to FIG. 2B, the first surface 206A of the printhead plate 206 is illustrated. For illustrative purposes, the printhead plate 206 is illustrated in FIG. 2B to be in a rectangular shape. Although described herein with reference to a printhead plate 206 having a rectangular shape, the present disclosure contemplates that the printhead plate 206 may have a different shape, such as square shape, without deviation from the scope of the disclosure.

The first surface 206A may support a first substrate 220A and a second substrate 220B. In an embodiment, the first substrate 220A may define at least heating elements of a first burn line 222A disposed adjacent to a first longitudinal edge "E1" of the printhead plate 206. The second substrate 220B may define at least heating elements of a second burn line 222B disposed adjacent to a second longitudinal edge "E2" of the printhead plate 206. The first longitudinal edge "E1" and the second longitudinal edge "E2" are located parallel and opposite to one another. Said differently, the first substrate 220A and the second substrate 220B are substantially parallel to the longitudinal edges "E1" and "E2", respectively.

In an example embodiment illustrated in FIG. 2B, the two longitudinal edges "E1" and "E2" of the first surface 206A of the printhead plate 206 support the substrates 220A and 220B, respectively, as long rectangular shapes. The substrates 220A and 220B may, in some embodiments, be made of insulating materials, such as alumina ceramic. Although described herein with reference to substrates 220A and 220B made of alumina ceramic, the present disclosure contemplates that the substrates 220A and 220B may be made of other such insulating materials, without deviation from the scope of the disclosure.

The heating elements of the first burn line 222A may be defined in a longitudinal direction along and adjacent to the first longitudinal edge "E1" of the first surface 206A of the printhead plate 206. In an embodiment, the heating elements of the first burn line 222A may be selectively activated, by a control unit (e.g., an external printhead control circuit) of the printing apparatus 100, when the printhead bracket 204 receives the printhead 202 in the first position to perform the printing operation. Thus, in the first position, the printhead 202 is secured within the printhead bracket 204 such that the heating elements of the first burn line 222A are aligned with a proximal end of the printhead bracket 204 and the heating elements of the second burn line 222B are aligned with a distal end of the printhead bracket 204. Further, in the first position, the printhead bracket 204 may be configured to preclude operation of the heating elements of the second burn line 222B.

Similarly, the heating elements of the second burn line 222B may be defined in a longitudinal direction along and adjacent to the first longitudinal edge "E2" of the first surface 206A of the printhead plate 206. In an embodiment, the heating elements of the second burn line 222B may be selectively activated, by the control unit, such as the external printhead control circuit, of the printing apparatus 100, when the printhead bracket 204 receives the printhead 202 in the second position to perform the printing operation. Thus, in the second position, the printhead 202 is secured within the printhead bracket 204 such that the heating elements of the second burn line 222B are aligned with a proximal end of the printhead bracket 204 and the heating elements of the first burn line 222A are aligned with a distal end of the printhead bracket 204. Further, in the second position, the printhead bracket 204 may be configured to preclude operation of the heating elements of the first burn line 222A.

A plurality of driver IC chips 224 and a Flexible Print Circuit (FPC) 226 on the first surface 206A of the printhead plate 206 are further illustrated in FIG. 2B. The plurality of driver IC chips 224 may include a first set of driver IC chips 224A and a second set of driver IC chips 224B. The first set of driver IC chips 224A may be disposed in parallel along the first longitudinal edge "E1" on the printhead plate 206 and the second set of driver IC chips 224B may be disposed in parallel along the second longitudinal edge "E2" on the printhead plate 206. In an embodiment, the first set of driver IC chips 224A may be disposed in parallel along the first longitudinal edge "E1" on the printhead plate 206 to selectively control and drive the heating elements of the first burn line 222A when the printhead 204 is secured within the printhead bracket 202 in the first position for performing the printing operation. In another embodiment, the second set of driver IC chips 224B may be disposed in parallel along the second longitudinal edge "E2" on the printhead plate 206 to selectively control and drive the heating elements of the second burn line 222B when the printhead plate 204 is secured within the printhead bracket 202 in the second position for performing the printing operation.

The FPC 226 may, in some embodiments, include circuitry on a semi-crystalline polymer, such as a polyimide film, that may be utilized as a connector circuit for leading a circuit terminal, formed on the two substrates 220A and 220B, to an external printhead control circuit (not shown). The FPC 226 is connected to the circuit terminal by soldering or by means of an adhesive material that may have dispersed electroconductive particles. In an embodiment, the two substrates 220A and 220B and the FPC 226 may be bonded with each other by a known means, for example, an adhesive containing dispersed electroconductive particles, to form the printhead plate 206.

As illustrated, the second surface 206B of the printhead plate 206 may support the heat sink 212 and may define a housing including a holding surface configured to securely hold the printhead 202 to an interface (e.g., via an adhesive, magnet, hook and loop connectors, or the like). The heat sink 212 may be formed from an extruded heat conductive material, such as aluminum, to facilitate the removal of heat generated by the printhead 202 during the printing operation. However, other materials, such as ceramics, plastics, and sheet metal, may also be used to form the heat sink 212, without deviation from the scope of the disclosure.

Although described herein with reference to the printhead 202, the printhead plate 206, and/or the printhead bracket 204 in rectangle shapes, the present disclosure contemplates that the printhead 202, the printhead plate 206, and/or the printhead bracket 204 may be of other shapes, such as a square shape, without deviation from the scope of the disclosure. Accordingly, there may be a variation in the count and positioning of the electronic components, such as the burn lines and connectors, in the printhead assembly 200. For example, in case the printhead 202, the printhead plate 206, and/or the printhead bracket 204 are square in shape with equal edges, there may be implemented at least four substrates (one substrate adjacent to an edge of the four edges), four burn lines (one burn line on one substrate adjacent to each edge) and four connectors (one connector corresponding to one edge) on each of the two surfaces of the printhead plate 206.

Figure 3A:
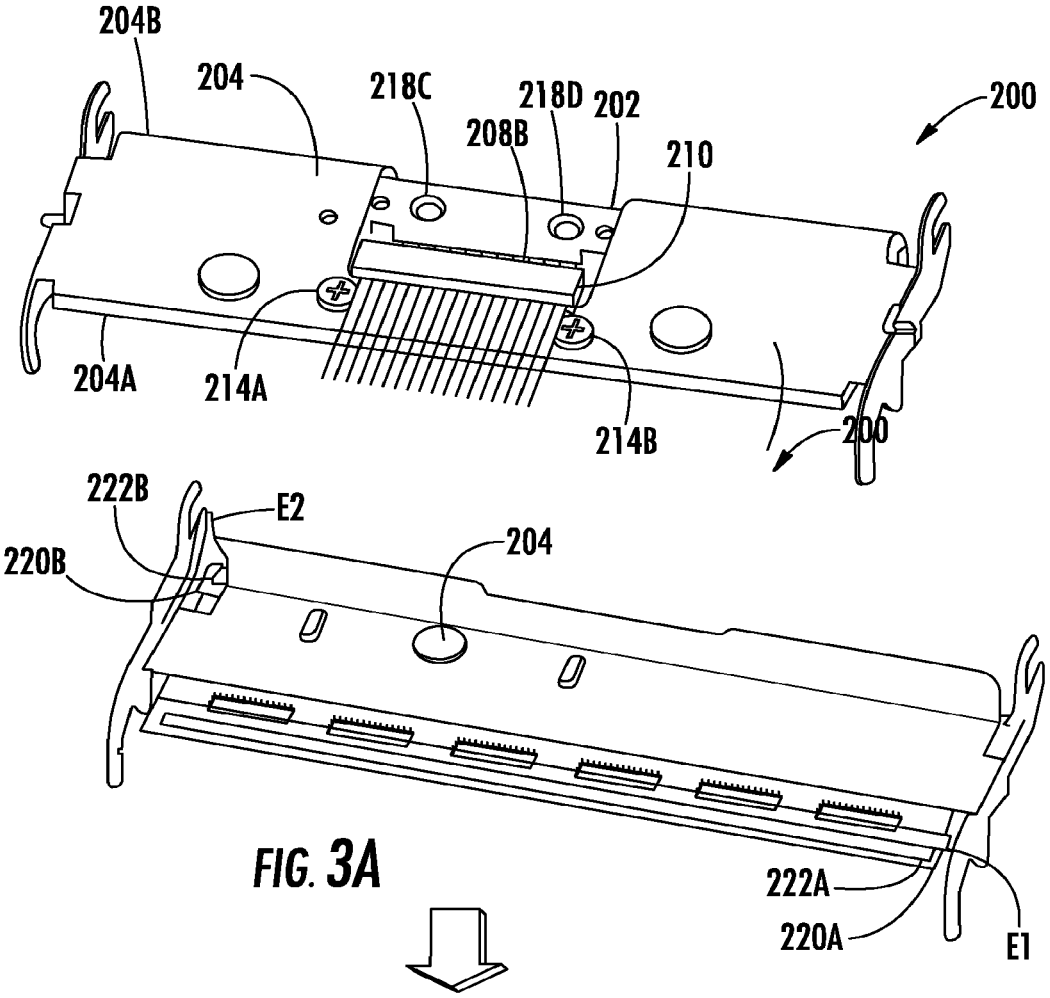
FIGS. 3A-3H illustrate movement of the printhead of FIG. 2A between a first position and a second position, in accordance with one or more embodiments of the present disclosure.
Figure 3B:
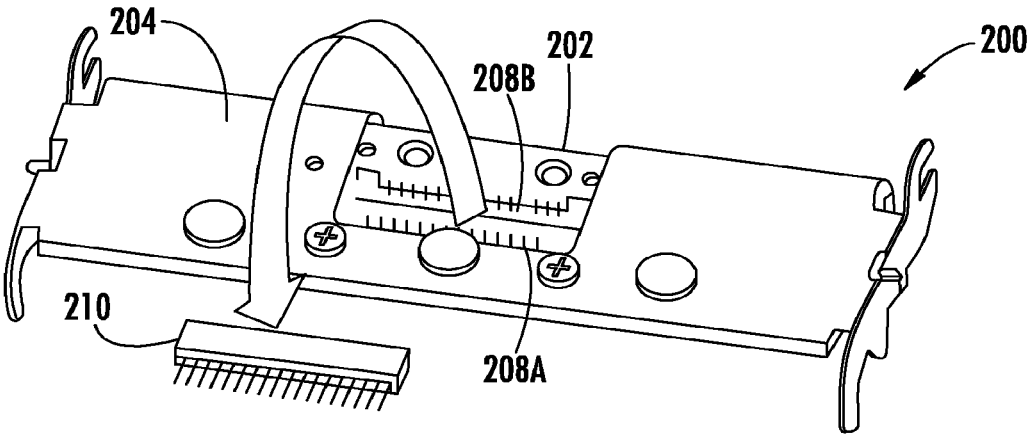
Figure 3C:
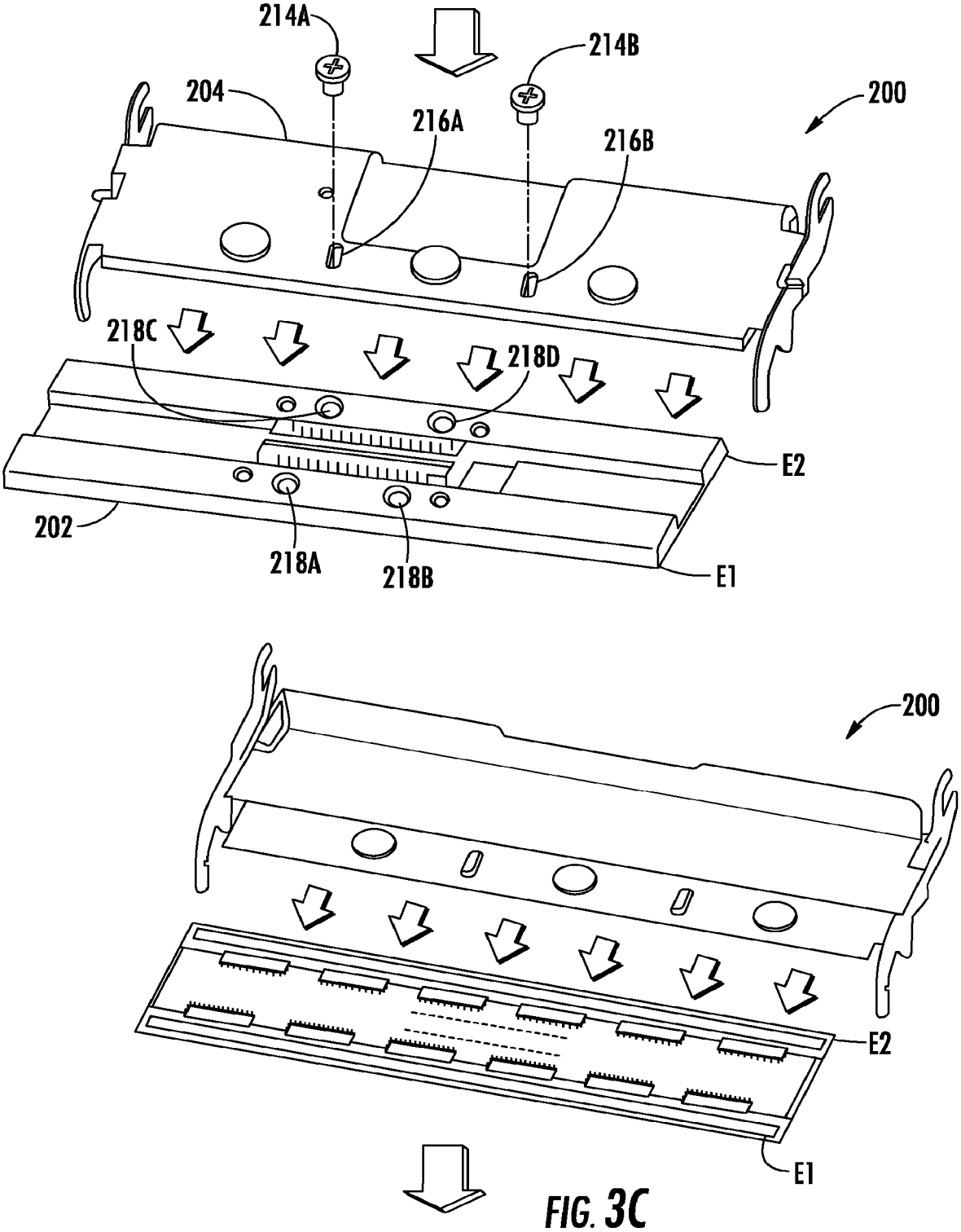
Figure 3D:
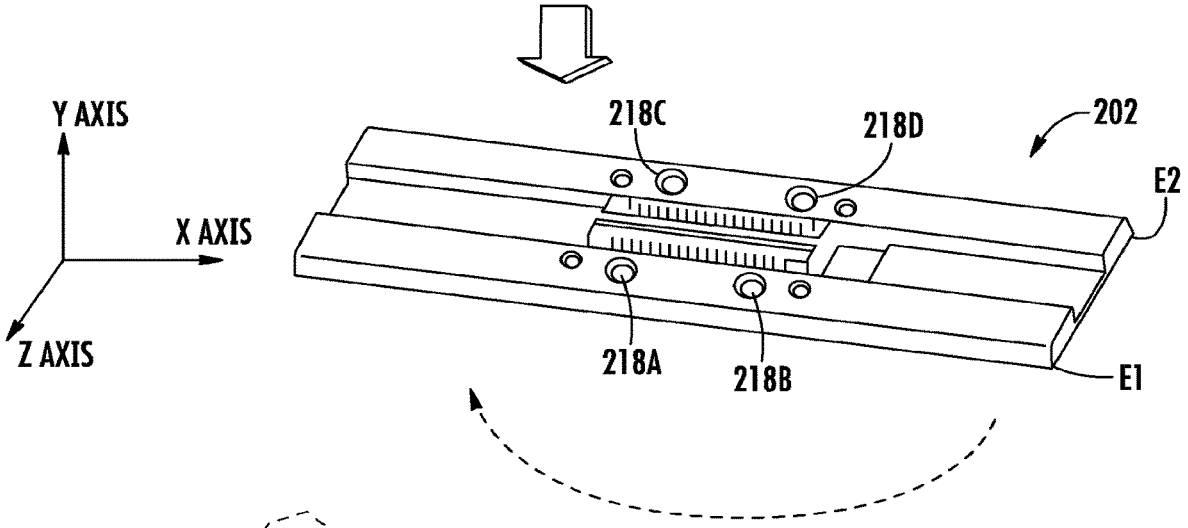
Figure 3E:
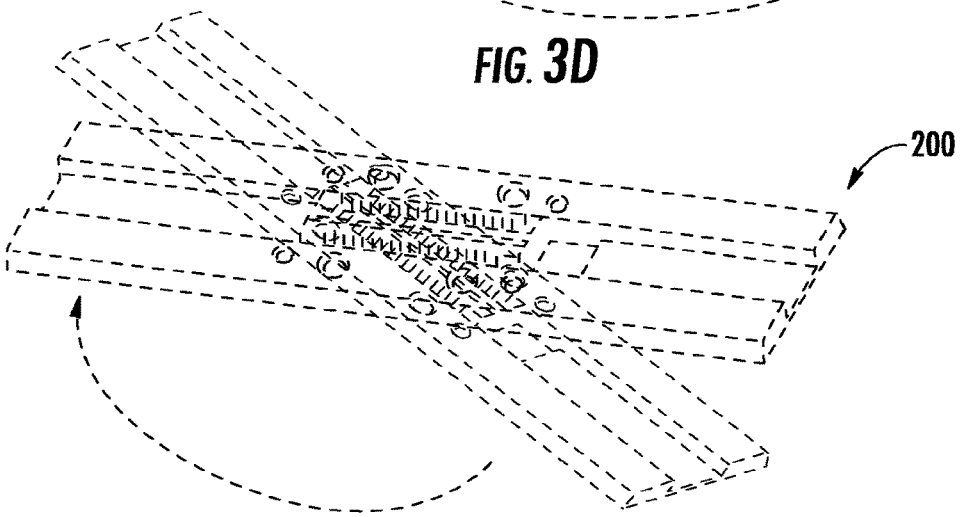
Figure 3F:
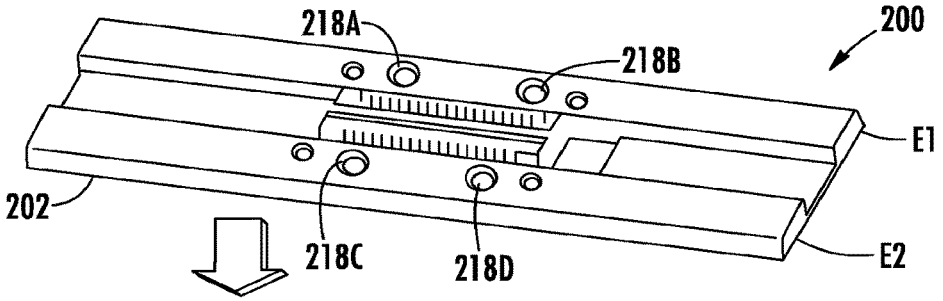
Figure 3G:
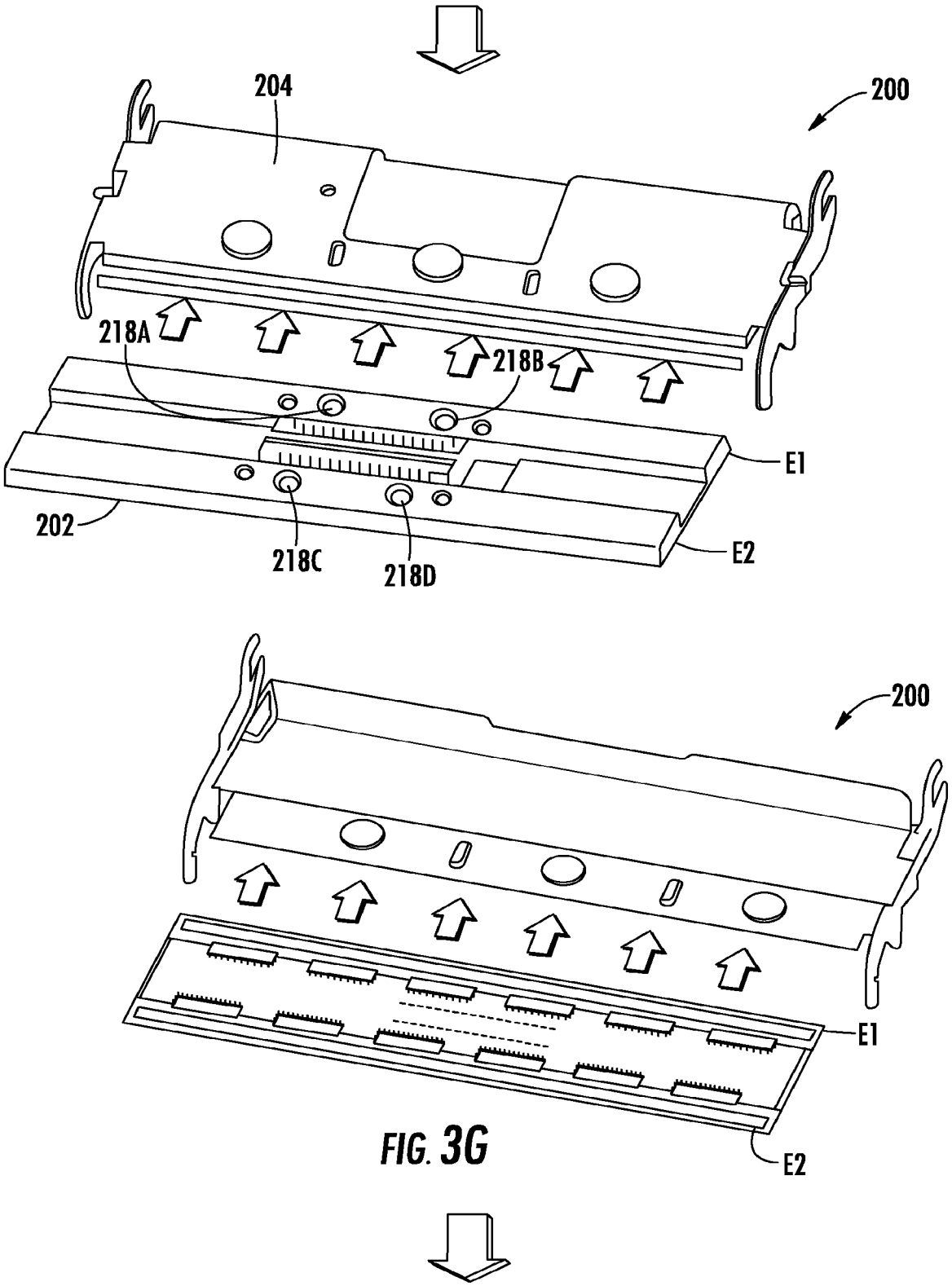
Figure 3H:
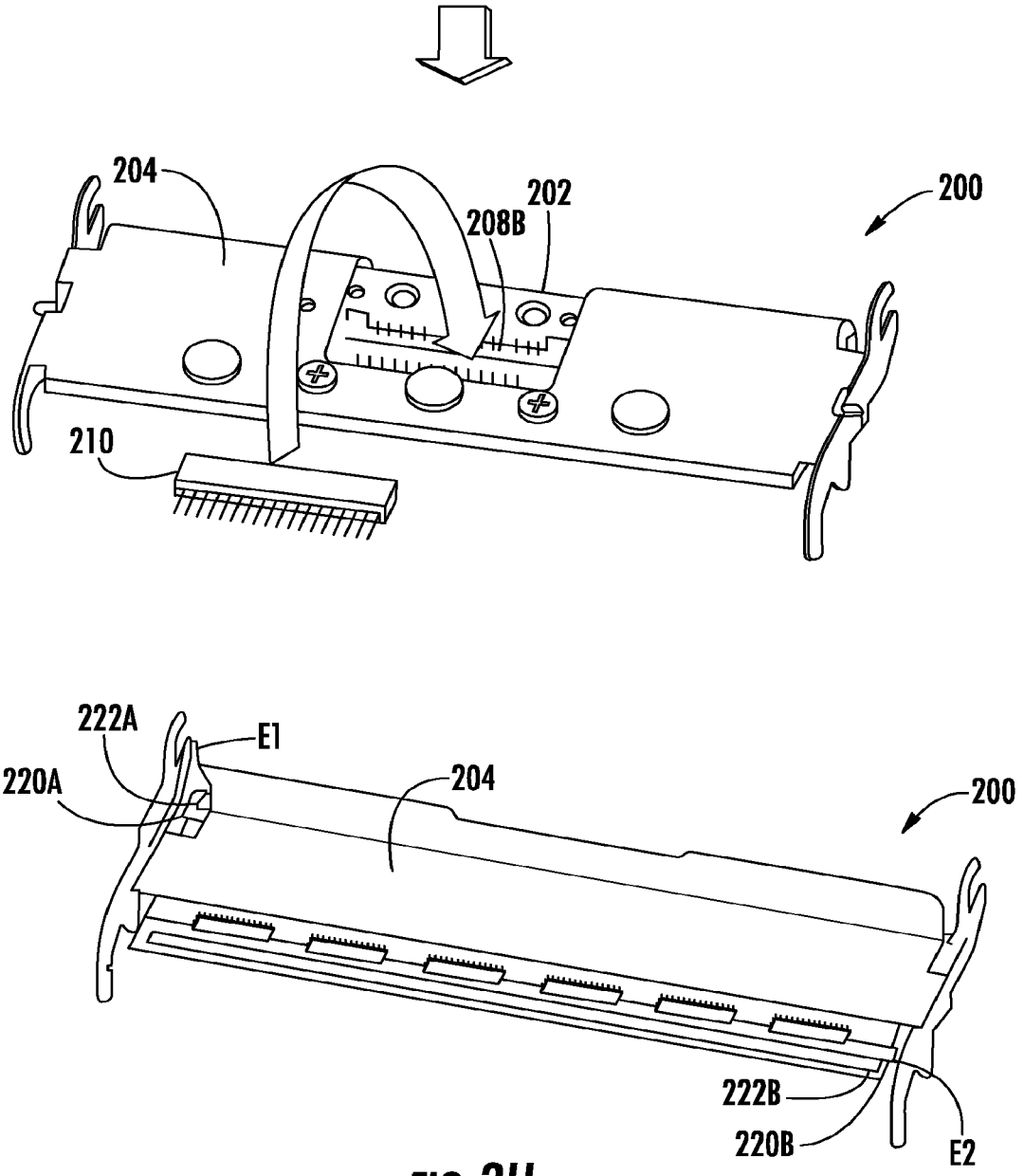

FIGS. 3A-3H illustrate movement of the printhead 202 of FIGS. 2A-2B between a first position and a second position, in accordance with one or more embodiments of the present disclosure. FIGS. 3A-3H are described in conjunction with FIGS. 2A-2B. Specifically, FIG. 3A illustrates top view of the printhead 202 in initial position, i.e. the first position, and FIG. 3H illustrates the top view of the printhead 202 in another position, i.e. the second position, for performing a printing operation. FIGS. 3B-3G illustrate intermediate positions during the movement of the printhead 202 of FIGS. 2A-2B between the first position and the second position.

As illustrated by the top view and bottom view of the printhead assembly 200 in FIG. 3A, the printhead 202 secured within the printhead bracket 204 in the first position, may be performing the printing operation under the control of a control unit (e.g., an external printhead control circuit) of the printing apparatus 100. As described with reference to FIG. 2A above, in an embodiment when the printhead 202 is secured within the printhead bracket 204 in the first position, the screws 214A and 214B are positioned within the first set of slots 216A and 216B formed in the printhead bracket 204 and the corresponding first set of slots 218A and 218B formed in the printhead 202.

In the first position, the external mating connector 210 may be connected to the connector 208A of the printhead 202, such that the heating elements of the first burn line 222A on the first substrate 220A are aligned with the proximal end 204A of the printhead bracket 204 and the heating elements of the second burn line 222B are aligned with the distal end 204B of the printhead bracket 204. In such position, the heating elements of the first burn line 222A are exposed to a media label for performing the printing operation and the heating elements of the second burn line 222B are covered by surface of the printhead bracket 204 that receives the printhead 202. Thus, the operation of the heating elements of the second burn line 222B may be precluded. In the first position, the heating elements of the first burn line 222A may be selectively activated by the control unit (e.g., an external printhead control circuit) of the printing apparatus 100.

In an example embodiment, the control unit (e.g., the external printhead control circuit) of the printing apparatus 100 may be configured to monitor the printing life of each of the first burn line 222A and the second burn line 222B. In response to the monitoring of the printing life of, for example the first burn line 222A, the control unit of the printing apparatus 100 may be further configured to detect one or more alert conditions associated with the heating elements of the first burn line 222A. In some embodiments, the alert condition may correspond to a malfunctioned state of the heating elements of the first burn line 222A. For example, the malfunction state of the heating elements of the first burn line 222A may correspond to a state when one or more heating elements of the first burn line 222A are overutilized, underutilized, overheated, underheated, and/or inoperative such that an improper printing operation may be performed. In other embodiments, the alert condition may correspond to end of printing life of the heating elements of the first burn line 222A.

In some embodiments, to determine the end of printing life of the heating elements of the first burn line 222A, the control unit may be configured to detect failure of heating elements of the first burn line 222A. The failure of the heating elements of the first burn line 222A may be caused due to various factors. Examples of such factors may include, but are not limited to, wearing down of the heating elements caused by the rubbing and friction of the printhead 202 beyond a specific time limit, creation of static build-up that is released without careful counter measures, uncontrolled heat settings, and/o undetected residual build-up. In some embodiments, to determine the end of printing life of the heating elements of the first burn line 222A, the control unit may be configured to perform sampling of resistance values for the heating elements of the first burn line 222A. Each sampled resistance value may be compared to its immediately preceding sampled resistance value for that heating element, upon which the control unit may be configured to determine a trend of the resistance of values for each heating element. The control unit may be further configured to determine the end of printing life of the heating elements of the first burn line 222A when a characteristic of the resistive trend deviates beyond a predetermined threshold value.

In some embodiments, to determine the malfunctioned state of the heating elements of the first burn line 222A, the control unit, in conjunction with a verifier module (not shown), of the printing apparatus 100 may be configured to retrieve a stored image of a label (printed by the heating elements of the first burn line 222A) from an associated memory unit and locate a barcode symbol in the stored image. The control unit may be further configured to analyze (e.g., via an edge detection application program) to find unprinted gaps in the located barcode symbol. Accordingly, based on the analysis, the control unit may be configured to determine a printer malfunction and generate a printer malfunction report. The printer malfunction report may include various data fields, such as, but not limited to a number of unprinted lines, a thickness of each line, and a location of each line with respect to a box edge surrounding the barcode symbol in the stored image.

In response to detection of the one or more alert conditions associated with the heating elements of the first burn line 222A, the control unit of the printing apparatus 100, may determine a required movement of the printhead 202 between the first position and the second position. The control unit may be configured to generate a notification or an error message for presentation on the display screen of the display assembly 114.

In an embodiment, upon presentation of the notification to the user for requesting the movement of the printhead 202 between the first position and the second position, a manual release of the printhead 202 in the first position received by the printhead bracket 204 may be initiated by the user, as illustrated in FIG. 3B. Accordingly, the external mating connector 210 may be disconnected from the connector 208A of the printhead 202.

As illustrated by the top view and bottom view of the printhead assembly 200 in FIG. 3C, the screws 214A and 214B may be dispositioned from the first set of slots 216A and 216B in the printhead bracket 204 and the first set of corresponding slots 218A and 218B in the printhead 202. The printhead 202 in the first position may be manually released from the printhead bracket 204. In another embodiment, in response to detection of the one or more alert conditions associated with the heating elements of the first burn line 222A, the control unit may be configured to cause the movement of the printhead 202 from the first position to the second position. In such a case, the printhead 202 received by the printhead bracket 204 in the first position may be automatically released from the printhead bracket 204, automatically rotated by a defined angular movement, and automatically secured within the second position in the printhead bracket 204. In such a case, there may be incorporated magnetic fastening mechanisms between the various components to facilitate the automatic release of the printhead 202 from the printhead bracket 204 and automatic securing of the printhead 202 within the printhead bracket 204.

As illustrated in FIGS. 3D-3F, the printhead 202 may be rotated by a defined angular value, such as 180 degrees. As shown in FIG. 3D, the printhead 202 is in a first orientation. In the first orientation, the first longitudinal edge "E1" of the first surface 206A of the printhead plate 206 in the printhead 202 is shown to be proximal and the second longitudinal edge "E2" of the first surface 206A of the printhead plate 206 in the printhead 202 is shown to be distal with respect to the Z-Axis. As shown in FIG. 3E, the printhead 202 is in an intermediate orientation during rotation by defined angular value, such as 180 degrees, along the Y-Axis. After rotation, as shown in FIG. 3F, the printhead 202 is in a second orientation. In the second orientation, the first longitudinal edge "E1" of the first surface 206A of the printhead plate 206 in the printhead 202 is shown to be distal and the second longitudinal edge "E2" of the first surface 206A of the printhead plate 206 in the printhead 202 is shown to be proximal with respect to the Z-Axis.

As illustrated by the top view and bottom view of the printhead assembly 200 in FIG. 3G, with the changed orientation in accordance with the defined angular value, the printhead bracket 204 may receive the printhead 202 in the second position with the heating elements of the second burn line 222B configured to be activated for performing the printing operation. In the second position, the printhead bracket 204 may receive the printhead 202 and may be secured by positioning the screws 214A and 214B within the first set of slots 216A and 216B formed in the printhead bracket 204 and the other second set of slots 218C and 218D formed in the printhead 202.

As illustrated by the top view and bottom view of the printhead assembly 200 in FIG. 3H, in the second position, the external mating connector 210 may be connected to the connector 208B of the printhead 202, such that the heating elements of the second burn line 222B on the second substrate 220B are aligned with the proximal end 204A of the printhead bracket 204 and the heating elements of the first burn line 222A are aligned with the distal end 204B of the printhead bracket 204. In such position, the heating elements of the second burn line 222B are exposed to the media label for the printing operation and the heating elements of the first burn line 222A are covered by surface of the printhead bracket 204 that receives the printhead 202. Thus, the operation of the heating elements of the first burn line 222A may be precluded. In the second position, the second plurality of heating elements in the heating elements of the second burn line 222B may be selectively activated, by the control unit (e.g., the external printhead control circuit) of the printing apparatus 100.

It may be noted that the angular value of the printhead 202 for rotation is defined to be 180 degrees, in accordance with an embodiment in which the printhead 202, the printhead plate 206, and/or the printhead bracket 204 are defined as a rectangular shape. However, in accordance with other embodiments, when the printhead 202, the printhead plate 206, and/or the printhead bracket 204 may have a different shape, the corresponding defined angular value may also be different. For example, when the printhead 202, the printhead plate 206, and/or the printhead bracket 204 have a square shape, the defined angular value may be 90 degrees. Such defined angular value of 90 degrees in such case may facilitate the printhead bracket 204 to receive the printhead 202 in one of four potential position such that each orientation corresponds to activation of heating elements in a corresponding burn line along an edge of the printhead plate 206. Although described herein with reference to the printhead 202, the printhead plate 206, and/or the printhead bracket 204 having a rectangular and square shape, the present disclosure contemplates that the printhead 202, the printhead plate 206, and/or the printhead bracket 204 may have any shape, without deviation from the scope of the disclosure. Accordingly, the defined angular movement may be based on the interior angles between consecutive edges of the shape. Such defined angular movement may facilitate the printhead bracket 204 to receive the printhead 202 in one of the various positions such that each orientation corresponds to activation of heating elements in corresponding burn line along an edge of the shape of the printhead plate 206.

The disclosed embodiments encompass numerous advantages. The embodiments, as presented in the present disclosure, disclose the printhead 202 having at least twice the life as compared to printheads in existing printing apparatuses. In existing printing apparatuses, the user is required to discard the printhead once the single burn line is exhausted, and the user is required to purchase a new printhead to replace the exhausted burn line in order to continue performing the printing operation. This may lead to unwanted hardware wastage as the rest of the components, such as the heat sink, the substrate, and/or the FPC in the printhead may still serve their functionalities. In contrast, the disclosed printhead 202 provides re-usage of such hardware components and provides for an extended life to the printing apparatus. This may result in processing speeds and reduced memory requirements of the printing apparatus. Further, as the new printhead is delivered to the user while the second burn line is performing the printing operation, productivity and efficiency gains associated with a printing operation may be observed.

In some example embodiments, certain ones of the operations herein may be modified or further amplified as described below. Moreover, in an embodiment additional optional operations may also be included. It should be appreciated that each of the modifications, optional additions or amplifications described herein may be included with the operations herein either alone or in combination with any others among the features described herein.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, such as, a combination of a DSP and a microprocessor, a plurality of microprocessors, one or more microprocessors in conjunction with a DSP core, or any other such configuration. Alternatively, some steps or methods may be performed by circuitry that is specific to a given function.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present disclosure(s). Furthermore, any advantages and features described above may relate to specific embodiments, but shall not limit the application of such issued claims to processes and structures accomplishing any or all of the above advantages or having any or all of the above features.

In addition, the section headings used herein are provided for consistency with the suggestions under 37 C.F.R. 1.77 or to otherwise provide organizational cues. These headings shall not limit or characterize the disclosure(s) set out in any claims that may issue from this disclosure. For instance, a description of a technology in the "Background" is not to be construed as an admission that certain technology is prior art to any disclosure(s) in this disclosure. Neither is the "Summary" to be considered as a limiting characterization of the disclosure(s) set forth in issued claims. Furthermore, any reference in this disclosure to "disclosure" in the singular should not be used to argue that there is only a single point of novelty in this disclosure. Multiple disclosures may be set forth according to the limitations of the multiple claims issuing from this disclosure, and such claims accordingly define the disclosure(s), and their equivalents, that are protected thereby. In all instances, the scope of the claims shall be considered on their own merits in light of this disclosure, but should not be constrained by the headings set forth herein.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Many modifications and other embodiments of the disclosures set forth herein will come to mind to one skilled in the art to which these disclosures pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the disclosures are not to be limited to the specific embodiments disclosed and that modifications and other embodiments are intended to be included within the scope of the appended claims. For example, the various elements or components may be combined or integrated in another system or certain features may be omitted or not implemented. Moreover, the steps in the method described above may not necessarily occur in the order depicted in the accompanying diagrams, and in some cases one or more of the steps depicted may occur substantially simultaneously, or additional steps may be involved.

Although specific terms are employed herein, they are used in a generic and descriptive sense only and not for purposes of limitation.

What is claimed is:

1. A method for operating a printing apparatus, the method comprising:

disengaging a print head engaged, in a first position, to a bracket of a print head assembly, the print head comprising a first burn line and a second burn line along two opposite ends of the print head, wherein in the first position, plurality of printing elements corresponding to the first burn line are configured to be activated by a control unit of a printer; and engaging the print head, in a second position, to the bracket, wherein in the second position, the plurality of the printing elements corresponding to the second burn line are configured to be activated by the control unit of the printer.

2. The method as claimed in claim 1, wherein the disengaging is based upon detection of a malfunctioning condition of at least of the printing elements corresponding to the first bum line of the substrate in the print head assembly.

3. The method as claimed in claim 1, wherein the substrate engaged in a first position is automatically released from the printhead bracket and rotated by a defined angular movement.

4. The method as claimed in claim 3, further comprising, magnetic fastening mechanisms between the various components to facilitate the automatic release of the printhead from the printhead bracket and automatic securing of the printhead within the printhead bracket.

5. The method as claimed in claim 4, further comprising, rotating the substrate by 180 degrees upon disengaging the substrate from the bracket and engaging the substrate upon rotation into the bracket in the second position for activating at least of the printing elements corresponding to the second bum line.

6. A printhead comprising:

a first substrate that defines at least a first burn line of heating elements disposed adjacent to a first edge of a printhead plate of a printhead; and a second substrate that defines at least a second burn line of heating elements disposed adjacent to a second edge of the printhead plate of the printhead, wherein the printhead is movably received by a printhead bracket in one of a first position or a second position, wherein, in the first position, the heating elements of the first burn line are configured to perform a printing operation, and operation of the heating elements of the second burn line is precluded by the printhead bracket, and wherein, in the second position, the heating elements of the second burn line are configured to perform the printing operation, and operation of the heating elements of the first burn line is precluded by the printhead bracket.

7. The printhead as claimed in claim 6, wherein the printhead is received by the printhead bracket in the first position, the printhead is secured within the printhead bracket such that the first burn line is aligned with a proximal end of the printhead bracket and the second burn line is aligned with a distal end of the printhead bracket.

8. The printhead as claimed in claim 6, wherein the printhead is received by the printhead bracket in the second position, the printhead is secured within the printhead bracket such that the second burn line is aligned with a proximal end of the printhead bracket and the first burn line is aligned with a distal end of the printhead bracket.

9. The printhead as claimed in claim 6, wherein the printhead further defines a first surface supporting the first substrate and the second substrate.

10. The printhead as claimed in claim 9, wherein the printhead further defines a second surface opposite the first surface, wherein the second surface is configured to support at least a heat sink.

11. The printhead as claimed in claim 9, wherein the printhead further comprises:

a first connector positioned on the second surface, wherein the first connector is configured to secure the printhead within the printhead bracket in the first position; and a second connector positioned on the second surface, wherein the second connector is configured to secure the printhead within the printhead bracket in the second position.

12. The printhead as claimed in claim 6, wherein at least one of the heating elements of the first burn line or the second burn line are configured to be selectively activated to perform the printing operation.

13. The printhead as claimed in claim 6, wherein a movement of the printhead between the first position and the second position, wherein the movement of the printhead corresponds to a release of the printhead received by the printhead bracket in the first position and a rotation of the printhead to be received by the printhead bracket in the second position.

* * * * *